US005643037A

United States Patent [19]

Altschul

[11] Patent Number: 5,643,037

[45] Date of Patent: Jul. 1, 1997

[54] PUPPET-LIKE TOY

[75] Inventor: Randice Lisa Altschul, 36 Cecilia Ave., Cliffside Park, N.J. 07010

[73] Assignee: Randice Lisa Altschul, Cliffside Park, N.J.

[21] Appl. No.: 562,174

[22] Filed: Nov. 22, 1995

[51] Int. Cl.[6] ..... A63H 3/14

[52] U.S. Cl. ..... 446/28; 446/327

[58] Field of Search ..... 446/26, 28, 327, 446/328

[56] References Cited

U.S. PATENT DOCUMENTS

| | | | |
|---|---|---|---|
| 1,267,567 | 5/1918 | Lundgren | 446/28 |
| 2,264,214 | 11/1941 | Lawrence | 446/28 |
| 2,526,217 | 10/1950 | Gilman | 482/88 |
| 2,754,121 | 7/1956 | Jupiter | 446/26 |
| 3,382,504 | 5/1968 | Barbosa | 446/26 |
| 4,138,745 | 2/1979 | Greenspan | 446/28 |
| 4,300,307 | 11/1981 | Biasuzzi et al. . | |
| 4,627,111 | 12/1986 | Storie | 446/28 |
| 4,697,286 | 10/1987 | Cho | 482/88 |
| 4,722,098 | 2/1988 | Stapleton | 446/28 |
| 4,799,889 | 1/1989 | Yockey | 446/328 |
| 5,209,691 | 5/1993 | Ekstein | 446/28 |

FOREIGN PATENT DOCUMENTS

| | | | |
|---|---|---|---|
| 795389 | 3/1936 | France | 446/28 |
| 1515100 | 6/1978 | United Kingdom . | |

*Primary Examiner*—Sam Rimell
*Assistant Examiner*—Jeffrey D. Carlson
*Attorney, Agent, or Firm*—Arthur Jacob

[57] ABSTRACT

An animal-like toy having hollow appendages into which a wearer can insert his arms and feet.

2 Claims, 3 Drawing Sheets

PUPPET-LIKE TOY

BACKGROUND OF THE INVENTION

1. Field of the Invention

The present invention generally relates to a puppet-like toy for children. Specifically, this invention is directed to an animal-like doll that is slightly smaller in stature than the child and is comforting to the child. In particular, this invention relates to a toy with which the child can walk around and pretend. More specifically, this toy is designed so that the child's arms and legs are made to fit into the animal's appendages so that the child can pretend to be like the animal.

2. Description of The Related Art

Children have always had many different types of toys with which they may pretend. Often, a child can either assume the toy's identity or the child can pretend that the toy assumes the identity of the child himself. Many devices have been designed which afford such identity transference. Puppets, for example, have long been known into which a person can place his hands and can make-believe the puppet is speaking.

U.S. Pat. No. 2,754,121 discloses a dancing doll. This doll is secured to a child by straps on its feet, hands, and back so that the child may pretend to dance with the doll. U.S. Pat. No. 4,722,098 discloses an animal-like costume which is entirely worn by a wearer so as to give the impression that the wearer is being carried by a figure. Neither of these disclosures address an animal-like figure which both allows a child to assume its identify while still able to retain his or her own identity. Finally, Hugsters, manufactured by Original Ideas™, are a sleeping bag in the form of a animal. The animal has four limbs having pockets in its paws. The child sleeping in the sleeping bag can place his hands in the paw pockets. This sleeping bag, however, does not allow a child to walk around and pretend the various games imagined by the child. The sleeping bag prevents the child's mobility.

SUMMARY OF THE INVENTION

Accordingly, there is now provided with this invention an improved animal or puppet-like toy approximately the same stature as the child, with which the child may walk around in a simple, convenient, and safe manner. More particularly, an animal-like toy is disclosed herein into which a child may insert his arms and or legs into its appendages. Additional objects of the present invention will become apparent in the following description. According to one aspect of the invention, an animal-like toy costume having appendages is disclosed herein. At least two of the appendages have hollow portions therein for receiving the arms of a wearer. Further, at least two of the appendages have hollow portions therein for receiving the feet of the wearer and straps for securing the feet thereto.

As will be appreciated by those persons skilled in the art, a major advantage provided by the present invention is a toy which a child can easily put on himself. Is therefore an object of the present invention to provide a safe, convenient, and easily donned item which allows a child to freely use his imagination. It is another object to provide a fairly large toy which can still be easily manipulated by the child. It is a further object of the invention to provide an animal-like toy which will be fun for a child to use and in which he can move about freely. It is a still further object of the invention to provide a comforting animal toy for a child.

The method and apparatus of the present invention will be better understood by reference to the following detailed discussion of specific embodiments and in the attached figures which illustrate and exemplify such embodiments.

DESCRIPTION OF DRAWINGS

A specific embodiment of the present invention will be described with reference to the following drawings wherein.

DESCRIPTION OF THE PREFERRED EMBODIMENT

Figure 1:
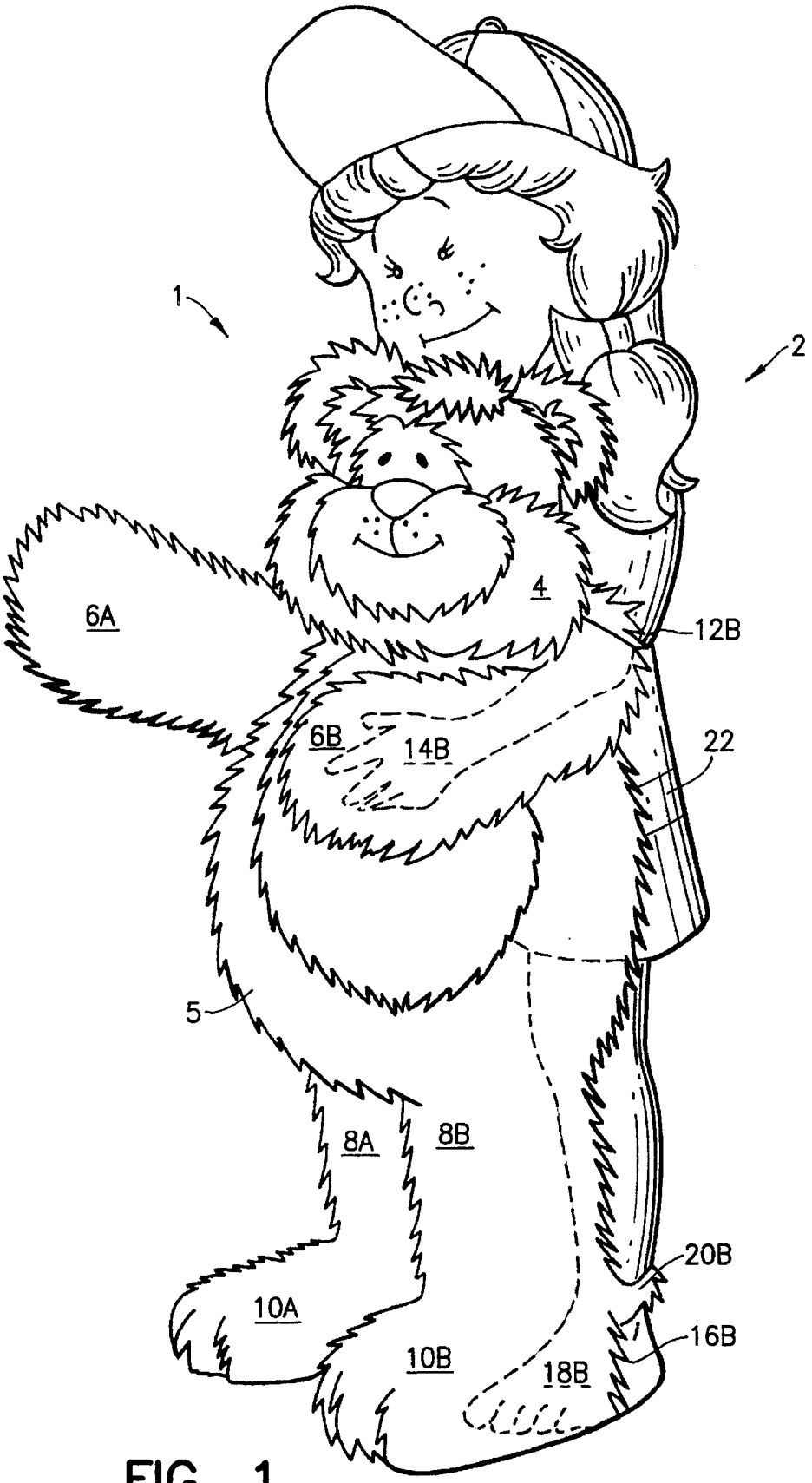
FIG. 1 is a front view of a child playing with the present invention.
Figure 2:
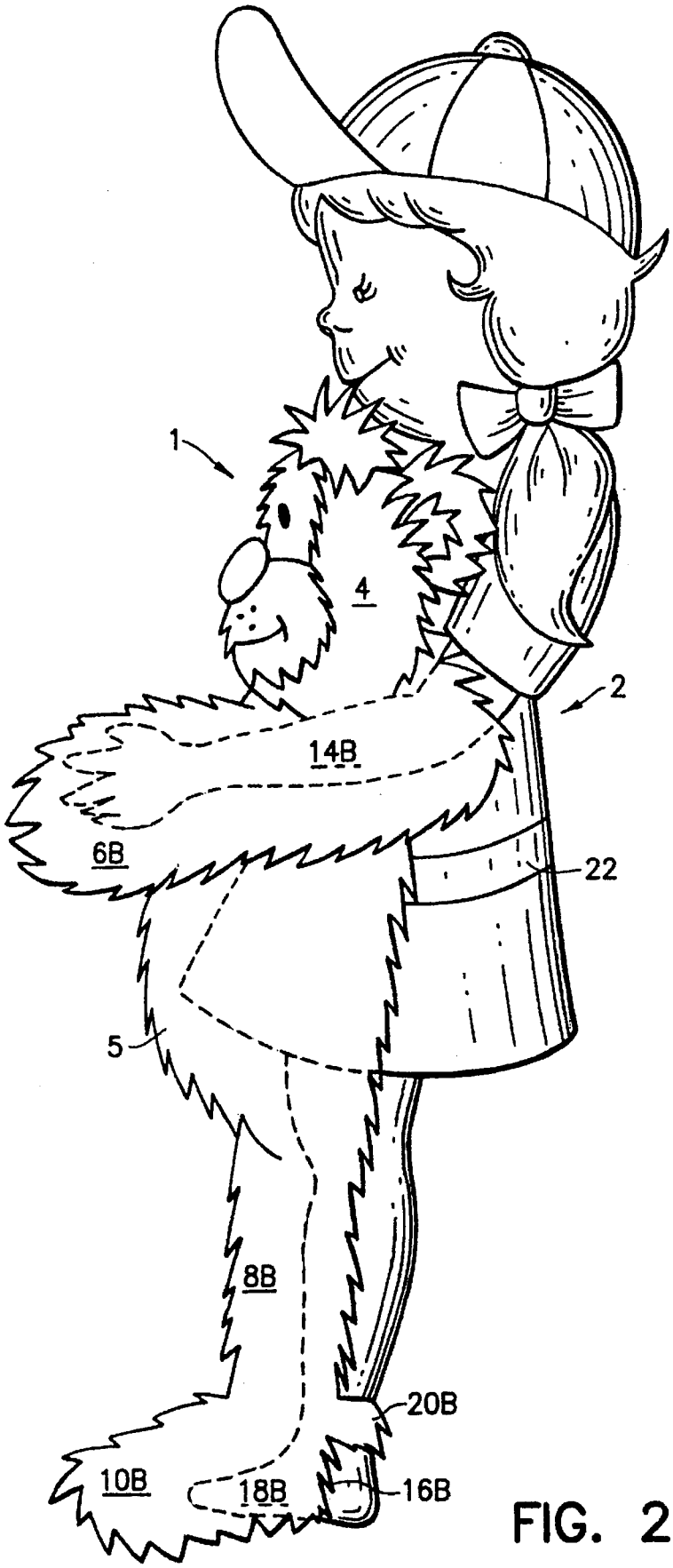
FIG. 2 is a side-view of the child playing with the present invention.
Figure 3:
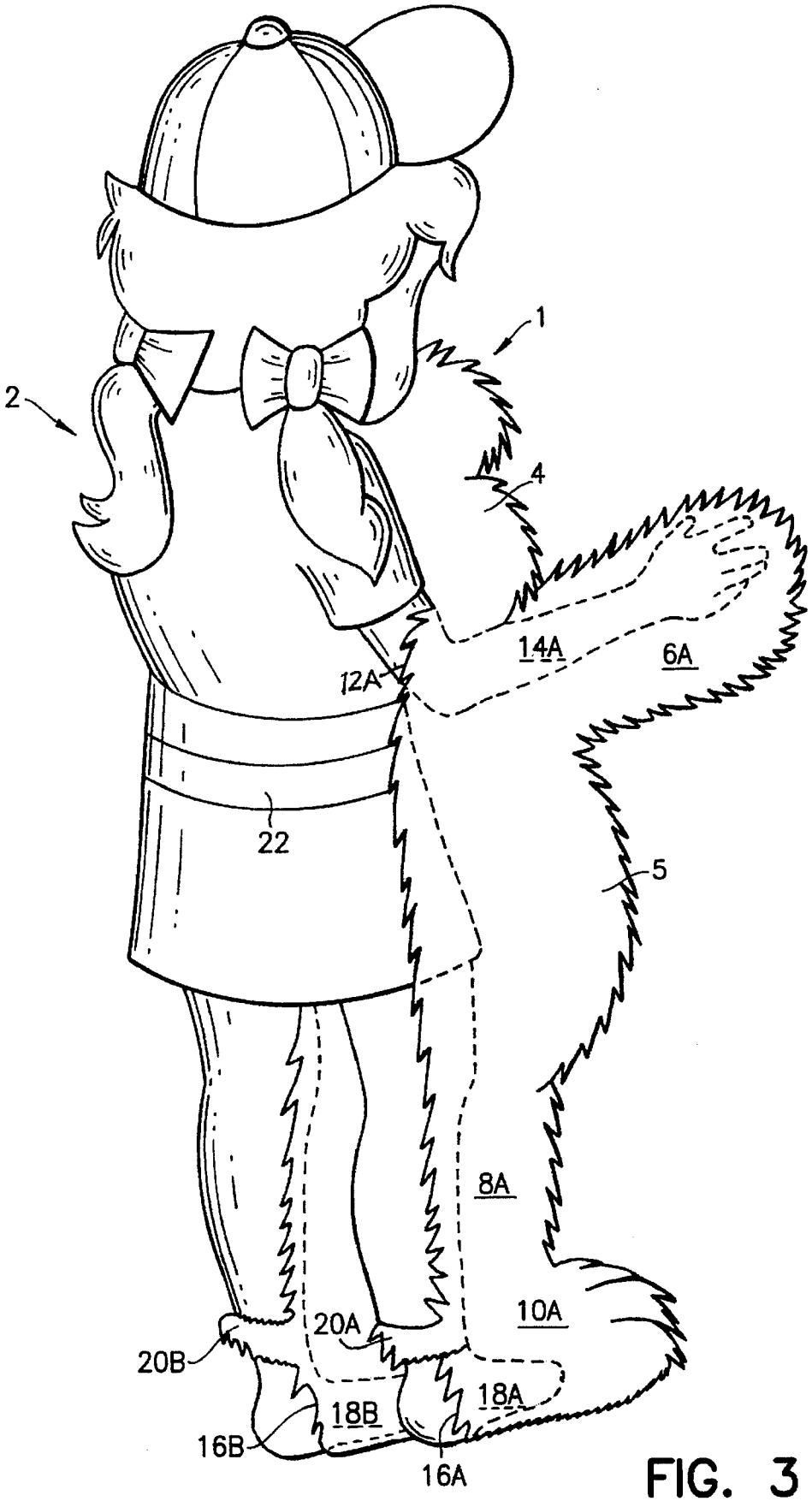
FIG. 3 is a rear-view of the child playing with the present invention.

The following preferred embodiment as exemplified by the drawings is illustrative of the invention and is not intended to limit the invention as encompassed by the claims of this application. In FIG. 1, an animal-like toy (1) is illustrated. The animal-like toy may be of a humanoid or non-humanoid form. A child (2) is shown behind the toy (1). Preferably, the toy (1) is stuffed with batting material thereby making it pleasing to hug and comforting to the child. The toy (1) is shown having a head (4), a trunk (5), and two arms (6*a* and 6*b*). The toy (1) also has two legs (8*a* and 8*b*) which terminate into two feet (10*a* and 10*b*), respectively. The toy (1) is substantially the same height as the child (2) and preferably the child's chin should rest upon the top of the toy's head (4). Both of the animal's arms (6*a* and 6*b*) are hollow. The arms (6*a* and 6*b*) have slots (12*a* and 12*b*) in the rear of the toy for providing entrances for the child's arms (14*a* and 14*b*) to be inserted into the hollows of the arms, respectively.

Of course, the toy may alternatively be provided with more than one set of limbs. In that case, all of the limbs may be provided with hollows each of which terminate in slots. These slots are for providing the child a choice of appendages into which to insert his arms. Alternatively, the toy may be provided with multiple sets of limbs, only one of which is hollow. The other limbs would not afford the child the possibility of inserting his arms therein.

The feet (10*a* and 10*b*) of the animal are also hollow and also have slots (16*a* and 16*b*), respectively. These slots (16*a* and 16*b*) provide entrances for the child's feet (18*a* and 18*b*) to insert into the hollows of the toy's feet. The legs (8*a* and 8*b*) are also provided with straps (20*a* and 20*b*). The straps are made to wrap around the child's leg to secure the child's feet (18*a* and 18*b*) in the hollows of the toy's feet (10*a* and 10*b*). The straps may be secured with a buckle or a hook and loop fastener (commonly known as Velcro™, or any other suitable fastening means. Further, additional straps may be provided for securing the animal to the child's body. For example, a strap (22) may be provided which extends around the child's midsection.

Of course, the toy may be provided with multiple legs and feet all of which may have hollows so that the child can choose which feet, into which he would like to insert his feet. Alternatively, the animal may have multiple legs and feet, only one pair of which have hollows for the insertion of the child's feet.

Although, the particular embodiment shown and described above will prove to be useful in many applications in children's toys and costumes and related art to which the present invention pertains, further modifications of the present invention herein disclosed will occur to a person skilled in the art. All such modifications are deemed to be within the scope and spirit of the present invention as defined by the appended claims.

I claim:

1. An animal-like toy for being coupled to a child of predetermined stature to enable the child to manipulate the toy through selected imitative movements into life-like configurations, including erect, active and cuddling configurations, to assume an identity related to the toy while maintaining the child's own identity, the toy comprising:

a trunk stuffed with a compliant material providing the trunk with a compliance comforting to the child while rendering the toy easily manipulated by the child through the selected imitative movements, the trunk having a front, a back and a height corresponding to the stature of a child;

a plurality of appendages extending from the trunk, each appendage having a first end and a second end, the first end of each appendage being integrated with the trunk at a corresponding affixation location such that each appendage extends from the corresponding affixation location toward the second end of the appendage;

at least two appendages of the plurality of appendages simulating arms and having hollow portions therein, each hollow portion extending from the first end toward the second end of the corresponding appendage, the two arm-simulating appendages being located on the trunk for receiving corresponding arms of the child within the hollow portions of the simulated-arm appendages, the hollow portions each having an entrance at the corresponding affixation location adjacent the back of the trunk and being closed adjacent the second ends of the simulated-arm appendages such that upon placement of the arms of the child within the hollow portions the child will be located behind the trunk and the corresponding arms of the child will extend in a direction from the back toward the front of the trunk while being enveloped within the hollow portions, hidden from view from the front of the trunk, to couple the arms of the child with the arm-simulating appendages; and at least two further appendages of the plurality of appendages simulating legs and carrying simulated feet at the corresponding second ends thereof, the simulated feet each having a front end and a back end and further hollow portions fully within the simulated feet, the two leg-simulating appendages being located on the trunk and extending from the trunk to place the simulated feet in position for receiving corresponding feet of the child slipper-like. within the simulated feet, the further hollow portions each having an entrance adjacent the corresponding back ends of the simulated feet and terminating short of the corresponding front ends such that upon placement of the feet of the child within the further hollow portions the child will be located behind the trunk and the feet of the child will extend in the direction from the back toward the front of the trunk while being enveloped within the further hollow portions, hidden from view from the front of the trunk, to couple the feet of the child with the simulated feet;

a strap extending from each simulated foot in a direction from the front of the trunk toward the back of the trunk for placement around the child adjacent the feet of the child to further secure the simulated feet to the child;

the height of the trunk, the extent of the arm-simulating appendages and the extent of the leg-simulating appendages enabling simultaneous placement of the arms and feet of the child within the respective hollow portions and further hollow portions, with the child located behind the trunk and the arms and feet of the child hidden from view from the front of the trunk such that the toy is manipulated readily through the selected imitative movements into life-like configurations, including erect, active and cuddling configurations, so that the child is able to assume the identity related to the toy while maintaining the child's own identity.

2. The toy of claim 1 including a further strap extending from the back of the trunk for placement around the child at a location between the arms and feet of the child to further secure the trunk to the child.

* * * * *